US006006714A

United States Patent [19]

Griffin et al.

[11] Patent Number: 6,006,714

[45] Date of Patent: Dec. 28, 1999

[54] SELF-SEALING ROTARY ASPIRATION SYSTEM FOR INTERNAL COMBUSTION ENGINES

[76] Inventors: Bill E. Griffin; Jackie L. Griffin, both of 5484 Gunshot Pass Dr., Colorado Springs, Colo. 80917

[21] Appl. No.: 08/855,215

[22] Filed: May 13, 1997

[51] Int. Cl.[6] ..... F01L 7/00

[52] U.S. Cl. ..... 123/190.6; 123/190.4; 123/190.1; 123/80 R; 123/80 BA

[58] Field of Search ..... 123/190.1, 190.12, 123/190.13, 190.4, 190.5, 190.6, 190.8, 190.11, 80 R, 80 BA, 80 BB, 80 C

[56] References Cited

U.S. PATENT DOCUMENTS

| | | | |
|---|---|---|---|
| 1,011,748 | 12/1911 | Coffin | 123/73 A |
| 1,153,676 | 9/1915 | Coffin | 123/80 BA |
| 1,181,974 | 5/1916 | Blye | 123/80 BA |
| 1,213,391 | 1/1917 | Goodrich | 123/80 C |
| 1,410,232 | 3/1922 | Warren | 123/190.1 |
| 1,477,591 | 12/1923 | Prescott | 123/74 AA |
| 1,527,605 | 2/1925 | Prescott | 123/190.8 |
| 1,545,205 | 7/1925 | Shaw | 123/80 BA |
| 1,871,502 | 8/1932 | Loach | 123/190.6 |
| 2,129,024 | 9/1938 | Reynolds | 123/59.1 |
| 3,730,161 | 5/1973 | Deane | 123/190.14 |
| 3,948,227 | 4/1976 | Guenther | 123/258 |
| 4,007,725 | 2/1977 | Weaver | 123/190.2 |
| 4,134,381 | 1/1979 | Little | 123/190.17 |
| 4,198,946 | 4/1980 | Rassey | 123/190.17 |
| 4,506,636 | 3/1985 | Negre et al. | 123/190.2 |
| 4,606,309 | 8/1986 | Fayard | 123/190.16 |
| 4,658,776 | 4/1987 | Coman . | |
| 4,739,737 | 4/1988 | Kruger . | |
| 5,095,870 | 3/1992 | Place et al. . | |
| 5,154,147 | 10/1992 | Muroki . | |
| 5,205,251 | 4/1993 | Conklin . | |
| 5,315,963 | 5/1994 | Warf . | |
| 5,315,969 | 5/1994 | MacMillan . | |
| 5,372,104 | 12/1994 | Griffin . | |
| 5,392,743 | 2/1995 | Dokonal . | |
| 5,490,485 | 2/1996 | Kutlucinar . | |
| 5,503,124 | 4/1996 | Wallis . | |
| 5,572,967 | 11/1996 | Donaldson, Jr. . | |
| 5,579,730 | 12/1996 | Trotter . | |

*Primary Examiner*—Noah P. Kamen
*Assistant Examiner*—Hai Huynh
*Attorney, Agent, or Firm*—Holme Roberts & Owen LLP

[57] ABSTRACT

The disclosed aspiration system provides an alternative to poppet valves for motor vehicle and other applications including gasoline, diesel, natural gas or other internal combustion engines. In one embodiment, an aspiration head (30) includes a housing defined by base plate (32), cover plate (34), end plates (36) and side plates (38). The base plate (32) is disposed directly above the engine cylinders and effectively forms a cylinder head. The head (30) further includes bottom ware plates (44) having elongate slots (46), a cylindrical rotor (50) having a rotor slot (48) and upper ware plates (56) having slots (46). Rotation of the rotor (50) allows for alternate charging and exhausting of the combustion chambers via the slots (46 and 48). The ware plates (44 and 58) are preferably formed from a material that is softer than the rotor (50), such as a phenolic material, such that the aspiration system is self-sealing.

13 Claims, 10 Drawing Sheets

SELF-SEALING ROTARY ASPIRATION SYSTEM FOR INTERNAL COMBUSTION ENGINES

FIELD OF THE INVENTION

The present invention relates in general to aspiration systems for internal combustion engines including four-stroke engines used for motor vehicle and other applications. In particular, the present invention relate; to a system for aspirating an internal combustion chamber without conventional reciprocating, or so-called poppet, valves. The invention thereby eliminates the need for various valve actuator components such as cams, lifters, rocker arms and push rods, and may also reduce or eliminate the need for various other automotive systems such as cooling systems and emission control systems, all while improving air throughput and efficiency.

BACKGROUND OF THE INVENTION

The four-stroke engine has achieved unparalleled acceptance including nearly universal use in internal combustion powered motor vehicles. The four strokes of such engines correspond to two full revolutions of a crankshaft and two reciprocal motion cycles of a piston in its cylinder, i.e., two downstrokes and two upstrokes. During the first downstroke, or intake stroke, a mixture of air and fuel or "charge" is drawn into the combustion chamber of the cylinder. The piston then returns towards the top of the cylinder to compress the charge during the compression stroke. The charge is then ignited, by a spark in non-diesel engines, and expands pushing the piston downward during the power stroke. In diesel engines, the charge ignites due to its own heat incident to compression. In the final or exhaust stroke, the piston rises to expel the combustion product.

In current motor vehicles, operation of the four stroke engine is controlled by reciprocating poppet valve systems. Such systems include at least one intake valve and one exhaust valve per cylinder. Each valve includes a valve head on the end of a valve rod that extends through an opening or valve guide, usually at the top end of the cylinder. A valve seat is formed at the opening. The valve is opened by lifting the valve head off of the seat into the combustion chamber, and is closed by returning the head to its seat. This motion is actuated by a cam rotating on a cam shaft. The cam is a disk-like element that contacts a bearing surface along its perimeter. The bearing surface is pressed towards the cam by a biasing spring. Most of the perimeter of the cam is circular, but one portion of the cam forms a lobe giving the cam a somewhat oblong shape. As the cam rotates, the lobe pushes the bearing surface outwardly during a portion of each revolution and then the bearing surface moves inwardly as the lobe passes. In the case of overhead camshafts, this motion is directly transmitted to the valve shaft to open and close the valve. In other cases, push rods, rocker arms and the like are employed to link the valve shaft to the bearing surface and cam.

Ideally, the intake valve would be open only during the intake stroke. That is, the intake valve would ideally open at top dead center of the piston cycle, remain open during the downward intake stroke, close at bottom dead center and remain closed until the beginning of the succeeding intake stroke. Similarly, the exhaust valve would ideally be open only during the exhaust stroke, i.e., from bottom dead center to top dead center. Both valves would ideally be closed throughout the compression and power strokes.

In reality, poppet valves do not work this way. Rather, the intake poppet valve typically opens during the exhaust stroke and remains open through the intake stroke and part of the compression stroke before closing. The exhaust poppet valve typically opens during the power stroke and remains open through the exhaust stroke and part of the intake stroke before closing.

The actual operation of the poppet valves as described above results in a number of anomalies. First, both valves are open at once during a portion of the cycle, i.e., during the last part of the exhaust stroke and the first part of the intake stroke. During this period, unused fuel passes from the intake port to the exhaust port resulting in waste and increased emissions. Second, the exhaust valve is open during the last part of the power stroke. As a result, the expanding charge, which is the payoff for the whole cycle, is allowed to blow out the exhaust rather than contributing to engine power. Third, the intake valve is open during the first part of the compression stroke resulting in lost compression and lost power. Finally, the exhaust valve is open during the first part of the intake stroke such that exhaust is sucked back into the combustion chamber together with the fresh charge. The net effect of these and other losses is that internal combustion engines under poppet valve operation typically achieve only about 40% or less of their theoretical work potential.

The anomalies noted above have been not only tolerated but considered essential by automotive engineers. Such engineers have noted, for example, that blowing unused and cool charge out the exhaust port helps to cool the exhaust valve so that higher compression ratios (e.g., 6:1) can be achieved without premature ignition or "dieseling." Mixing of hot exhaust gases with fresh charge during the intake is thought to result in improved atomization of the fuel and combustion. Moreover, practical limitations relating to the desired smooth profile of the cam and improved biasing spring wear prevent realization of ideal power cycle operation.

Even apart from timing considerations, conventional poppet valve systems are not very good aspirators. Ultimately, the potential power of an engine is limited by the amount of charge that the engine can throughput, and efficiency is limited by how completely fuel can be combusted and used. Both of these considerations require that engines process large amounts of air. Unfortunately, as poppet valves begin to open, the valve heads continue to obstruct flow thereby limiting the rate at which air cain be processed. The size of the circular intake and exhaust ports also limits air processing rates. Moreover, operating limitations typically require the fuel/air mixture to be maintained at about 14% fuel or richer, further limiting air processing.

Numerous attempts have been made to improve upon poppet valves including various systems that are generally referred to as rotary valves. Generally, though, these systems have not matured into practical designs. In many cases, rotary valves have failed to seal adequately under operating conditions resulting in poor compression, have worn quickly, have allowed lubricant to leak into the combustion chamber and/or have been unreasonably costly to produce. It is apparent that no fully satisfactory alternative to poppet valves has gained widespread acceptance in the industry.

SUMMARY OF THE INVENTION

The present invention provides an alternative to poppet valves for motor vehicle and other applications including gasoline, diesel, natural gas or other internal combustion engines. The aspiration system of the present invention operates without reciprocating valve heads and associated valve seats or other conventional seals and without any valve elements that extend into the engine cylinders. The invention allows for full aspiration (i.e., intake and exhaust) of multiple combustion chambers with only one moving part within the aspiration head, and no separate seals, moving bearings, lubricants or coolants. In addition, the aspiration system of the present invention can achieve substantially ideal aspiration timing with enhanced air throughput, and can thereby allow internal combustion engines to more closely approach their theoretical potential with reduced harmful emissions.

In one aspect, the aspiration system of the present invention allows for charging and exhausting of a combustion chamber of an internal combustion engine via transverse flows through a rotor. According to this aspect of the invention, the aspiration system includes a rotor having a rotation axis, an intake subsystem including two intake passageways each having an end adjacent to the rotor and an exhaust subsystem including two exhaust passageways each having an end adjacent to the rotor. The intake subsystem can be used to deliver charge or just an oxygen-containing gas such as air to the combustion chamber, i.e., the fuel can be delivered separately. The passageway ends of the respective intake subsystem and the exhaust subsystem are located at substantially overlapping longitudinal positions relative to the rotation axis of the roller. That is, each of the intake passageway ends are located at substantially the same position or in at least partially overlapped positions along the length of the rotor, and the same is true with respect to the exhaust passageway ends. The intake passageway ends can be located in longitudinally overlapping positions relative to the exhaust passageway ends, or can be offset therefrom. The rotor includes at least one transverse bore for alternately allowing communication between the intake passageways and between the exhaust passageways. A single bore can be used for intake and exhaust or more than one bore can be provided. Preferably, the bore(s) allows for substantially linear flow, transversely through the rotor. In one embodiment, a straight bore extending diametrically through a cylindrical rotor alternately interconnects the intake passageways and the exhaust passageways. The aspiration system thereby employs a rotor for control of intake and exhaust, has a reduced length relative to the rotation axis, and allows for increased flow rates to and from the combustion chamber.

Preferably, the intake passageway ends and the corresponding rotor bore(s), and the exhaust passageway ends and the corresponding rotor bore(s), have matching cross-sections selected for enhanced flow and all of the passageway ends and bore(s) are positioned to achieve the desired timing relative to operation of the internal combustion engine. In this regard, the rotor preferably includes a bore that has a length, relative to the rotor rotation axis, that is greater than its width relative to a direction transverse to the length i.e., the bore has an aspect ratio of length/width that is greater than 1. The passageway ends associated with the bore preferably have substantially matching dimensions. Upon consideration of the embodiments described in detail below, it will be appreciated that opening and closing of the intake and exhaust passageways in such embodiments are controlled by width-wise rotation of the bore across the respective passageway ends. The above-noted aspect ratio thus allows for improved cross-sectional flow area for a given point Where the bore overlaps the passageway ends. The length of the bore can be greater than one-half of the diameter of the combustion chamber and, in one embodiment, is at least about two-thirds to three-quarters of the combustion chamber diameter. The widths of the bore and passageway ends are preferably selected in relation to the rate of rotation of the rotor and the rate of rotation of an engine crank shaft associated with a piston such that the bore overlaps a passageway end for a period of time corresponding to one stroke of the piston or 180° of rotation of the crank shaft. For a rotor rotation rate that is one-fourth of the crank shaft rotation rate, the width of each of the rotor bore ends can be defined as a chord of two points separated by 22½° relative to a circumference of a cylindrical rotor. In such a case, an exhaust passageway can be offset from an intake passageway by a distance equal to the width of the rotor bore ends.

In another aspect, the present invention allows for charging and exhausting of two or more combustion chambers of an internal combustion engine by employing an aspiration system that can be controlled using a single rotor. The aspiration system includes an intake subsystem for delivering charge (with or without the fuel pre-mixed) to each of the combustion chambers, an exhaust subsystem for extracting a combustion product from each of the combustion chambers and a rotor for controlling flow through the intake and exhaust subsystems. The rotor is preferably cylindrical in shape with apertures for aspirating all of the combustion chambers and has a length sufficient to extend across all of the combustion chambers. The invention thereby provides for charging and exhausting of multiple combustion chambers with a minimum of moving parts and correspondingly reduced weight and complexity.

According to a further aspect of the invention, an aspiration system including a split bearing head is provided. It has been recognized that a persistent problem associated with proposed rotary valve systems has been maintaining the position and rotational stability of the rotors in operation. This has been particularly problematic due to the significant temperature and pressure variations experienced in operation together with the requirement, in such proposed systems, for flexible sealing elements such as gaskets and O-rings at the rotor interface. It will be appreciated that even small movements, relative expansions or rotational wobbling, as well as any taper in a cylindrical rotor, can cause seal failures and loss of compression, excess friction and heat or noise, and/or other malfunctions in prior art systems.

Such concerns are addressed in accordance with the present aspect of the invention by providing an aspiration system including a cylindrical rotor and a split bearing head having first and second bearing elements. The bearing elements are disposed on opposite sides of the rotational axis of the cylindrical rotor. Each of the bearing elements includes a curved surface for bearing against an outer surface of the cylindrical rotor where the curved surface has a curvature that is substantially the same as the curvature of the outer rotor surface. Additionally, the bearing elements are separated from one another by a distance and therefore are not in contact. Each of the curved bearing surfaces preferably has different lengths relative to the rotational axis of the rotor at different portions thereof. This arrangement accommodates minor thermal expansions with reduced friction while maintaining proper rotor positioning and rotational stability. In particular, the rotational axis of the rotor can be maintained separately (e.g., via separate bearings) from controlling the position of the bearing head elements relative to the rotor, and the bearing head elements can independently adapt to the rotor position and to dimensional changes due to wear.

According to a still further aspect of the present invention, a self-sealing head is provided for use in an aspiration system of an internal combustion engine. The head is for use in conjunction with a metallic rotor. The head includes a body defining at least one passageway for charging and/or exhausting a combustion chamber of the engine and a bearing surface. The bearing surface defines a profile that complements an outer surface of the metallic rotor and is formed from a nonmetallic material capable of sealingly engaging against an outer surface of the rotor. The nonmetallic material is preferably somewhat more resilient than the rotor body and may be a phenolic. The passageway of the rotor body has an end at the bearing surface. In certain embodiments, the rotor body includes separate passageways for intake and exhaust. The passageways can be longitudinally overlapped or longitudinally displaced relative to one another.

According to another aspect, the aspiration system of the present invention includes a cylindrical rotor for use in controlling at least one of charging and exhausting of an engine combustion chamber and a flow-through bearing head. The rotor includes at least one passageway for allowing flow of exhaust and/or charge. The bearing head includes a curved bearing surface for bearing against a curved outer surface of the cylinder and at least one head passageway for communicating with the passageway of the rotor. The head passageway extends to the bearing surface and a seal is formed around the head passageway and due to contact between the bearing surface and the outer surface of the cylinder. In this regard, one of the contacting surfaces is preferably nonmetallic. The sealing interface between the flow-through bearing and the rotor overcomes the persistent sealing and compression problems of other designs.

The present invention in another aspect involves an engine with a novel piston/head interface. The engine includes a cylinder, a cylinder head defining a passageway for charging and/or exhausting the cylinder, and a piston mounted for reciprocating motion within the cylinder where the piston includes a piston head surface shaped so that the piston head surface extends into the passageway of the cylinder head at an extreme position of the piston's reciprocating motion. This arrangement has particular application in connection with aspiration systems that are free from valve elements extending into the cylinder. The novel piston/head interface allows for an improved compression ratio by reducing the minimum combustion chamber volume defined by the cylinder, piston and cylinder head.

The present invention provides internal combustion engine systems that operate in ways widely thought to be impossible or impractical. For example, it is axiomatic among many designers that internal combustion engines should receive a charge that is no leaner than 14% fuel in order to function properly. The present invention provides an engine system, and corresponding method of operation, that involves delivering a charge comprising no more than about 10%, and preferably between about 4%–6%, fuel by volume to a combustion chamber, and combusting the lean charge to realize power. Additionally, the present invention provides an engine system, and corresponding method of operation, the involves processing a volume of charge of at least about 62 times the engine displacement volume per second (e.g., 302 cubic feet per minute of charge in a 2,300 cubic centimeter engine). The invention also provides a gasoline powered engine system, and corresponding method of operation, that achieves an operating compression ratio of greater than 16:1 and, preferably, at least about 23:1 without premature ignition or dieseling. Additional novel aspects of the invention and advantages will be apparent upon consideration of the description below.

BRIEF DESCRIPTION OF THE DRAWINGS

For a more complete understanding of the present invention and further advantages thereof, reference is now made to the following Detailed Description, taken in conjunction with the drawings, in which.

DETAILED DESCRIPTION OF THE INVENTION

In the following description, the invention is set forth in the context of a particular aspiration system mounted on a particular type of internal combustion engine. It will be appreciated, however, that various aspects of the invention have broader application and are not limited to the exemplary embodiments set forth in detail below.

Figure 1:
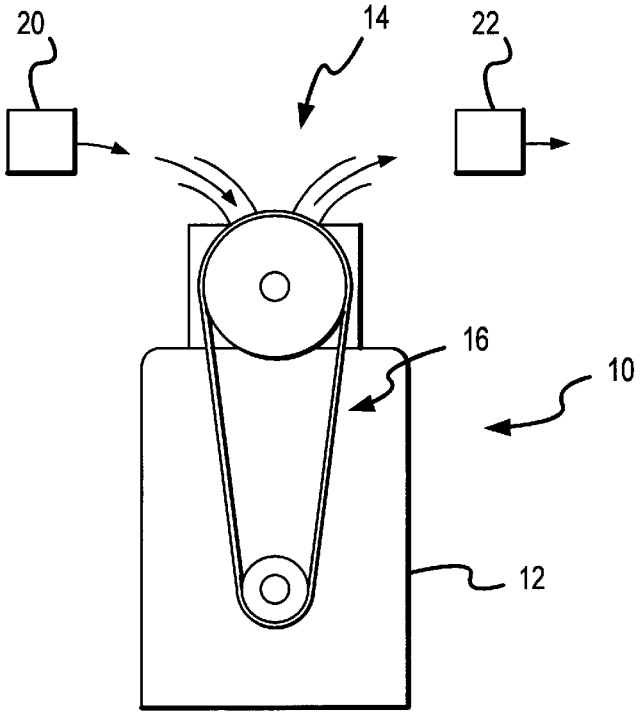
FIG. 1 is a front view, partially schematic, showing an internal combustion engine constructed in accordance with the present invention.
Figure 2:
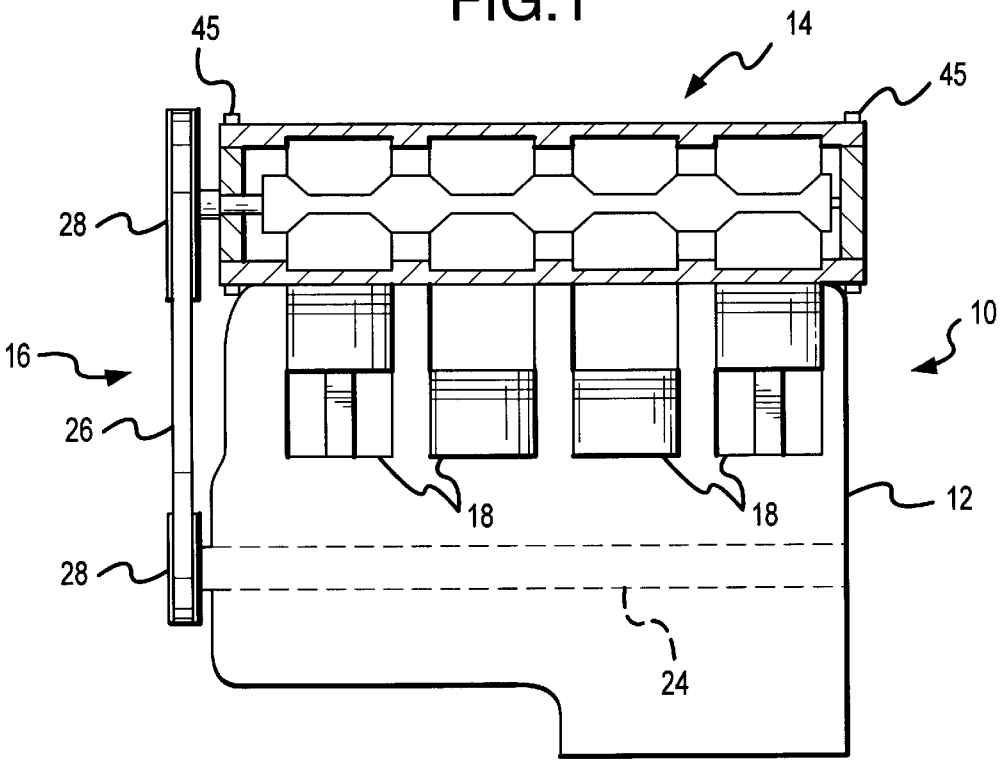
FIG. 2 is a side view, partially in cross-section, of a portion of the engine of FIG. 1.

Referring to FIGS. 1 and 2, front and side views, respectively, of an internal combustion engine 10 are shown. Generally, the engine 10 includes an engine block 12, an aspiration system 14, and linkage 16 for driving the aspiration system 14. Each of these is described in detail below.

The present invention can be applied to a variety of internal combustion engines including gasoline, diesel and natural gas powered engines for motor vehicles and other applications. Additionally, the invention is applicable to engines having any number of cylinders and various block configurations including in-line and "V" configurations. The illustrated engine is a four-cylinder, four-stroke, in-line gasoline powered internal combustion engine. Although the block 12, as illustrated, appears of conventional variety, and the present invention can in fact be retrofitted or otherwise applied to existing engines, it is anticipated that manufacturers will dramatically reduce engine sizes to take full advantage of the efficiencies and power enhancements of the present invention. It should also be noted that the aspiration system 14 does not require oil and the engine lubrication system may be modified accordingly.

The aspiration system 14 aspirates the engine 10 by providing charges of air and fuel to the combustion chambers of cylinders 18 and exhausting combustion products therefrom. The illustrated system 14 receives charge from an intake unit 20, such as a carburetor or fuel injection system, and discharges exhaust to an exhaust system 22. The illustrated intake unit is an electronic fuel injection unit. The fuel injection unit can be of a conventional variety but functions, in accordance with the present invention, to provide a surprisingly lean air/fuel mixture for use in the engine 10. In pairticular, the illustrated engine 10 with aspiration system 14 preferably breathes in a charge that is no more than 10% fuel by volume and, more preferably, is about 4–6% fuel by volume, the remainder being an oxygen-containing gas, e.g., air. Alternatively, in accordance with the present invention, the intake unit may provide only air, and the fuel may be directly injected into a turbulence chamber associated with the combustion chamber at a selected moment of the engine cycle. The exhaust system 22, in the case of motor vehicles, may include conventional emissions control devices and a tailpipe or the like for discharging the treated exhaust to the ambient environment. However, upon consideration of the description below, it will be appreciated that such emissions control systems may be substantially altered, or even eliminated in large part, due to the clean burning characteristics of the present invention. The remaining portions of the aspiration system 14 are described in greater detail below.

Linkage 16 is employed to drive a rotor of aspiration system 14, preferably in cooperation with the crank shaft 24 of engine 10. In the embodiments described below, the rotor rotates at a rate that is one-quarter the rotation rate of the crankshaft; accordingly, the linkage provides an effective 4:1 gear ratio. Any appropriate power transmission elements can be used in this regard, including gears or chain-and-sprocket assemblies. The linkage of the illustrated embodiment includes at least one drive belt 26 extending over two or more pulleys 28.

Figure 3:
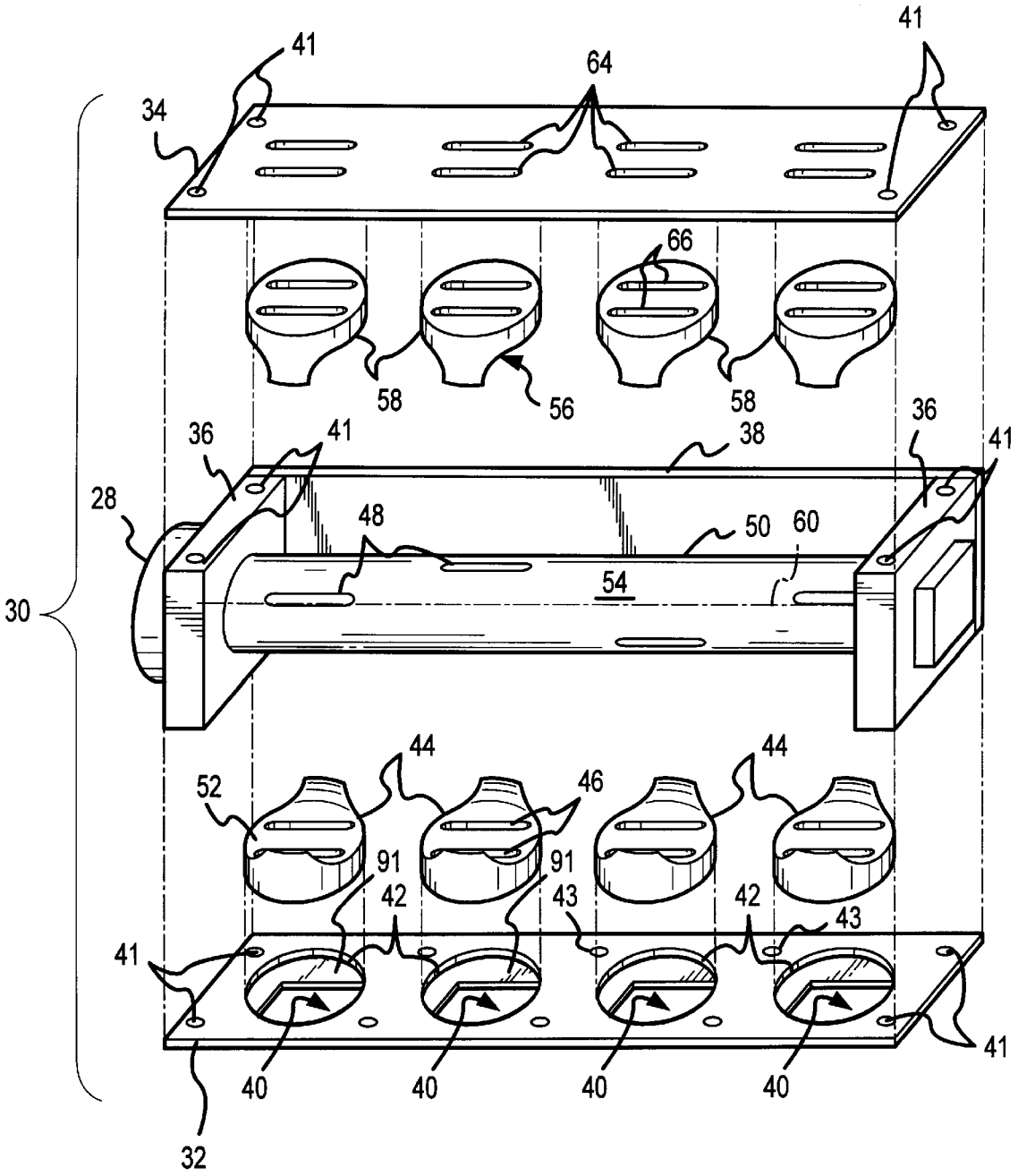
FIG. 3 is an exploded view of an aspiration head of the engine of FIG. 1.

FIG. 3 shows an exploded perspective view of an aspiration head 30 of the aspiration system 14. A side plate of the head 30 has been eliminated for clarity of illustration. The head 30 includes a housing defined by base plate 32, cover plate 34, end plates 36 and side plates 38 (only one shown), all of which may be formed from a metal, for example, aluminum. The base plate 32 is disposed directly above the engine cylinders and effectively forms a cylinder head. In this regard, the illustrated base plate 32 includes four rectangular windows 40 (also shown in the top view of FIG. 6), corresponding to the four cylinders of the engine of FIGS. 1–2, that allow charge and exhaust to pass through base plate 32. The base plate 32 also includes four recesses 42 for seating the four bottom ware plates 44, as will be described in greater detail below.

The bottom ware plates 44 include elongate slots 46 that extend linearly through the ware plates 44 from top to bottom. The slots 46 communicate with corresponding slot 48 of rotor 50 to alternately charge and exhaust the combustion chambers of the cylinders as will be described below. The rotor 50 may be of any diameter, depending on the particular engine application. The curved upper surfaces 52 of the ware plates 44 bear against the outer surface 54 of the rotor 50 such that a seal is formed around the slots 46 and 48 due to contact between the upper surfaces 52 and the outer surface 54. In this regard, the upper surfaces 52 of the ware plates 44 have a curvature that is substantially the same as the curvature of the outer surface 54 of the rotor 50. The upper surfaces 52 of the illustrated head 30 extend around a portion of the rotor 50, but not so far around as to contact the similarly shaped and functioning lower surfaces 56 of the upper ware plates 58. The upper 52 and lower 56 surfaces have a length, measured relative to rotation axis 60, that varies from side to side reflecting the circular cross-sectional shape of the ware plates 44 and 58.

The rotor 50 is mounted on the shaft of pulley 28 so as to rotate in unison therewith. The rotation of the rotor 50 about axis 60 is facilitated and stabilized by bearings at both ends of the shaft. The bearings are preferably located in the end plates 36. The top ware plates 58 arc seated in recesses (not shown) in cover plate 34. The cover plate 34 also includes elongate slots 64, corresponding to the slots 66 in top ware plates 58, for charging and exhausting the combustion chambers.

The overall head 30 is assembled by way of appropriate fasteners, such as screws or bolts 45 (FIG. 1) that extend through the entire height of the head 30, i.e., through the base plate 32, cover plate 34 and end plates 36. The bolts 45 pass through the holes 41 shown in FIG. 3. Registration pins may be provided on various of the housing plates to facilitate alignment. The simplicity of construction of the aspiration head 30 will thus be appreciated. Additionally, it will be noted that only one moving part, i.e., the rotor 50, is required within the aspiration head housing to fully aspirate all of the combustion chambers.

Figure 6:
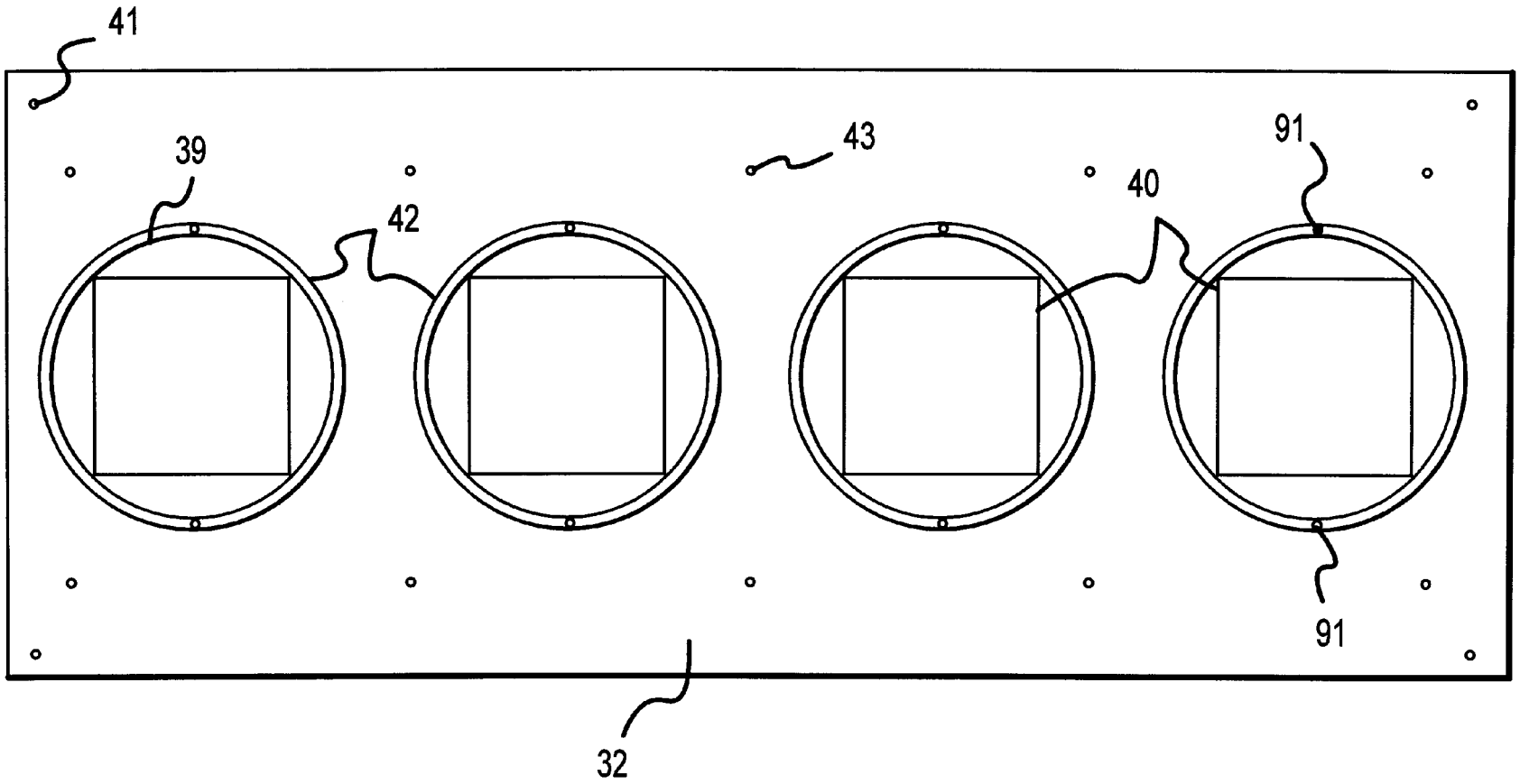
FIG. 6 is a top view of the base plate of the aspiration head of FIG. 3.

FIG. 6 also shows O-rings 39 that are seated in a groove on the ledges formed between the side walls of recesses 42 and the windows 40. These O-rings 39 allow the bottom ware plates 44 to float in operation, thereby assuring tight sealing contact between the ware plates 44 and rotor 50 throughout the engine's power cycle, relaxing tolerances, and accommodating any wear or slight tapers in the rotor 50. The dimensions of the rotor 50, ware plates 44, recesses 42 and base plate, as well as the location of the rotor bearings relative to the end plates 36, are selected such that there would be a slight gap (e.g., 0.010") between the rotor 50 and ware plates 44 in the absence of the O-rings 39. The O-rings 39 take up this slack such that the O-rings 39 arc compressed between the ware plates 44 and the base plate 32 when the bolts 45 (FIG. 1) are tightened down. The elasticity of the O-rings 39 urges the ware plates 44 against the rotor 50 and acts as a shock absorber against pressure fluctuations. The O-rings 39 may be formed, for example, from VITON, manufactured by DuPont. FIG. 6 also shows the holes 43 for bolting the base plate 32 to the engine block.

Figure 4:
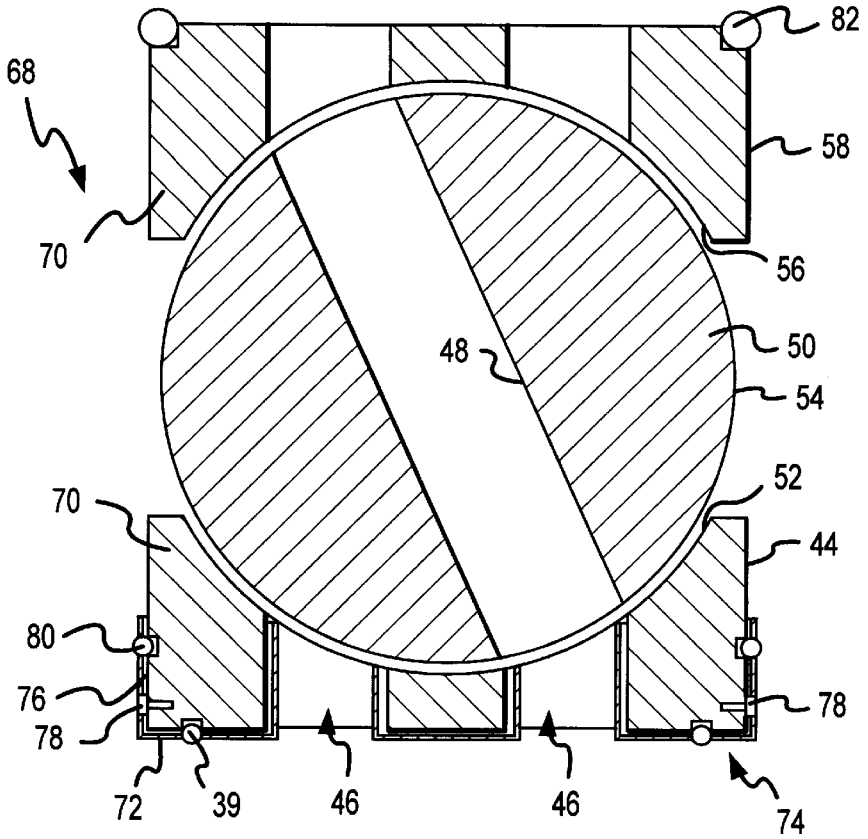
FIG. 4 is a front cross-sectional view of a rotor block assembly of the aspiration head of FIG. 3.

FIG. 4 shows a front cross-sectional view of a rotor block assembly 68 including rotor 50, bottom ware plate 44 and top ware plate 58. It should be noted that, although FIG. 4 shows a slight gap between the rotor 50 and the ware plates 44 and 58 for ease of illustration, the ware plates 44 and 58 would, in reality, be in contact so as to form a seal at the interface therebetween. In order to effect such a seal with reduced friction, the opposing surfaces of the rotor 50 and ware plates 44 and 58 are preferably formed from dissimilar materials. In the illustrated embodiment, the rotor is formed from metal such as heat-treated steel and preferably has a hardness of at least about 5–8.5 on the Mohs hardness scale. The steel of the illustrated rotor is hardened to a hardness of about 54 Rockwell. The cuter surface 54 of the rotor is preferably textured, for example, with a fine cross-hatch pattern to enhance the sealing properties of the surface 54. At least the bearing surfaces 52 and 56 of the plates 44 and 58 are preferably formed from a somewhat softer or more compliant or resilient material. Such material preferably has a hardness of less than about 5 on the Mohs hardness scale and may, for example, be a thermosetting polymer material that is heat set at, or is otherwise dimensionally stable and tolerant of a temperature of at least about 150° C. The material should also have a high resistance to wear. The ware plate bearing surface material should also be highly resistant to degradation upon exposure to intake and exhaust substances. One material that has been found to provide exceptional sealing, heat resistance, friction and wear properties is the fiber reinforced phenolic material marketed under the trade name BAKELITE of Union Carbide. The bodies 70 of the illustrated ware plates 44 and 58 are formed from such a material.

The bottom ware plate 44 includes a cap 74 for heat protection. As previously noted, the bottom of ware plate 44 is exposed to the combustion chamber. Due to the improved combustion characteristics of the present invention, the ware plate 44 may be subjected to very high temperatures. In order to fully protect the ware plate 44, it is desirable to apply a thermal barrier coating to the bottom and internal slot surfaces of the ware plate 44. The thermal barrier coating 72 of the illustrated embodiment provides a thermal barrier at temperatures up to about 5000° F. (about 1927° C.) and may be, for example Zirconia Ytterium. The barrier coating is preferably applied using a bonding agent (e.g., a Nichrome-based agent) to a metallic base 76, that can be formed from aluminum. The cap 74 is attached to the body 70 of ware plate 44 by pins 78. A similar barrier coating is preferably applied to the base plate and other surfaces exposed to the combustion chamber, e.g., the piston head. In this regard, it is noted that substantially all of the resulting combustion heat can be channeled out of the exhaust passageways, thereby reducing or eliminating the need for a cooling system.

The rotor block assembly also includes sealing elements 80, 81 and 82, such as elastomeric O-rings, which may be formed from VITON, housed in notches formed in the ware plates 44 and 58, that improve the seal at the ware plate/rotor interfaces as well as substantially preventing leakage between the aspiration head and cover 34 or base plate 32. As previously noted, the ware plates 44 and 58 are seated in recesses of the base plate 32 (FIG. 3) and cover plate 34, respectively. Sealing element 80 is sandwiched between the ware plate 44 and recess wall of the base plate 32 so as to form a seal therebetween. The sealing element 80 can be a piston ring instead of an O-ring. In such case, steel inserts may be provided in the ring slot and around the wall of recess 42 to reduce wear. Sealing element 39 is sandwiched between the bottom of ware plate 44 and base plate 32. For ease of construction, element 39 may be retained within a recess formed on the bottom of ware plate 44. Sealing element 82 is sandwiched between ware plate 58 and the recess base and side wall of cover plate 34. It should be noted that the sealing element 82 is compressed between the cover plate 34 and the top ware plate 58 such that the elasticity of the sealing element urges the ware plate 58 into firm sealing contact with the rotor 50. Similarly, the seal formed by element 80 in conjunction with pressure from the combustion chamber (in conjunction with O-rings 39 as described above) urges the ware plate 44 into firm sealing contact with the rotor 50 at critical points in the power cycle. In this regard, openings 91 extend through the base plate 32 so that pressure from the combustion chamber improves the operation of element 80. The split design of the rotor block assembly 68 and independent movement of the respective ware plates 44 and 58 thereby improves the ware plate/rotor seal. Additionally, this design accommodates any relative thermal expansions or minor tapering of the cylindrical rotor 50 over its length, thereby relaxing manufacturing tolerances, reducing the likelihood of malfunction, and enhancing performance.

Figure 5:
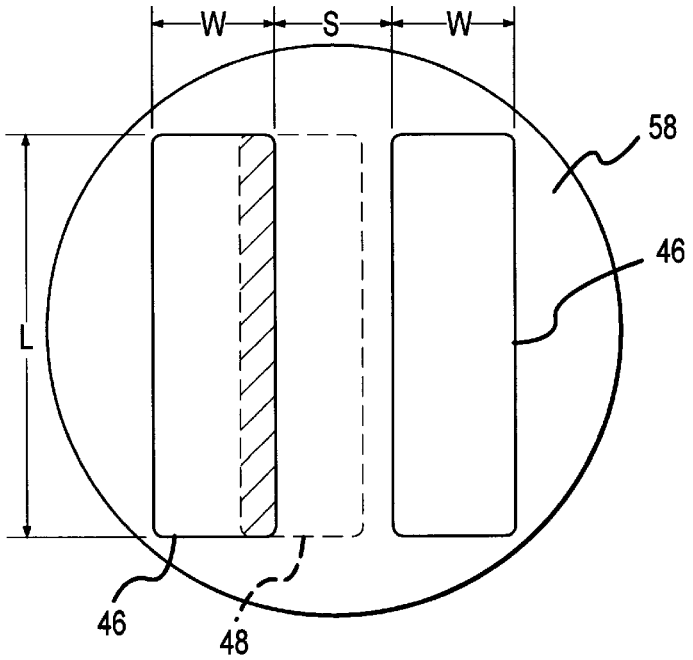
FIG. 5 is a bottom view of the lop ware plate of the assembly of FIG. 4, showing a ware plate passageway and a rotor passageway in an overlapped relationship.

FIG. 5 shows a bottom view of the top ware plate 58. The slot dimensions of the bottom ware plate 44 (FIG. 4) would be substantially identical to the dimensions of upper ware plate slots 46 as shown in FIG. 5. The slot design provides for enhanced charge and exhaust flow through the aspiration head. As shown in FIG. 5, the slots have a relatively large length, L, in relation to their width, W. These dimensions are substantially the same as those of the rotor slot 48, shown in phantom in FIG. 5. The slots 46 and 48 are shown in an overlapping relationship corresponding to a time shortly before the exhaust stroke is complete. Due to the elongate shape of the slots 46 and 48, a substantial flow cross-sectional area (shaded in FIG. 5) is available for continued exhausting of the combustion chamber even though the passageway defined by the slots is about to close. Similarly, a large passageway area is available for charge intake substantially immediately upon passageway opening.

The length, L, of the slots 46 and 48 (as well as slots 46 of bottom ware plate) can be selected to achieve a desired charge flow, e.g., 300 $ft^3$/min. The maximum slot length, L, for a given aspiration system of a given engine, may be determined, as a practical matter, by structural requirements regarding the thickness of ware plate material that must remain adjacent to the outside slot corners. in the illustrated embodiment, the ware plate 58 is similar in diameter to the cylinder disposed beneath bottom ware plate 58, and the length, L, is preferably greater than ½ of the cylinder diameter and, more preferably, is about ⅔ to ¾ of the cylinder diameter.

The width of the slots 46 and 48, W, and the spacing, S, between the slots 46 and 48, is selected to achieve the desired aspiration timing with respect to the engine's power cycle. As will be understood from the description below, the two slots 46 correspond to an intake flow line and an exhaust flow line through the rotor block aspiration system 14 (FIG. 1). In order to achieve the desired timing for a four-stroke cycle with a rotor rotation rate of ¼ the crankshaft rotation rate and no overlap as between the intake and exhaust flows, the width of the slots 46 and 48 and the spacing between, S, are all selected so as to correspond to an arc that is 1/16 of the circumference of the rotor. The linear width for a given rotor of radius r would therefore be given by the formula:

$$w=s=2r \sin(\theta/2)$$

where $\theta=1/16(360°)$ or 22.5°.

Figure 7:
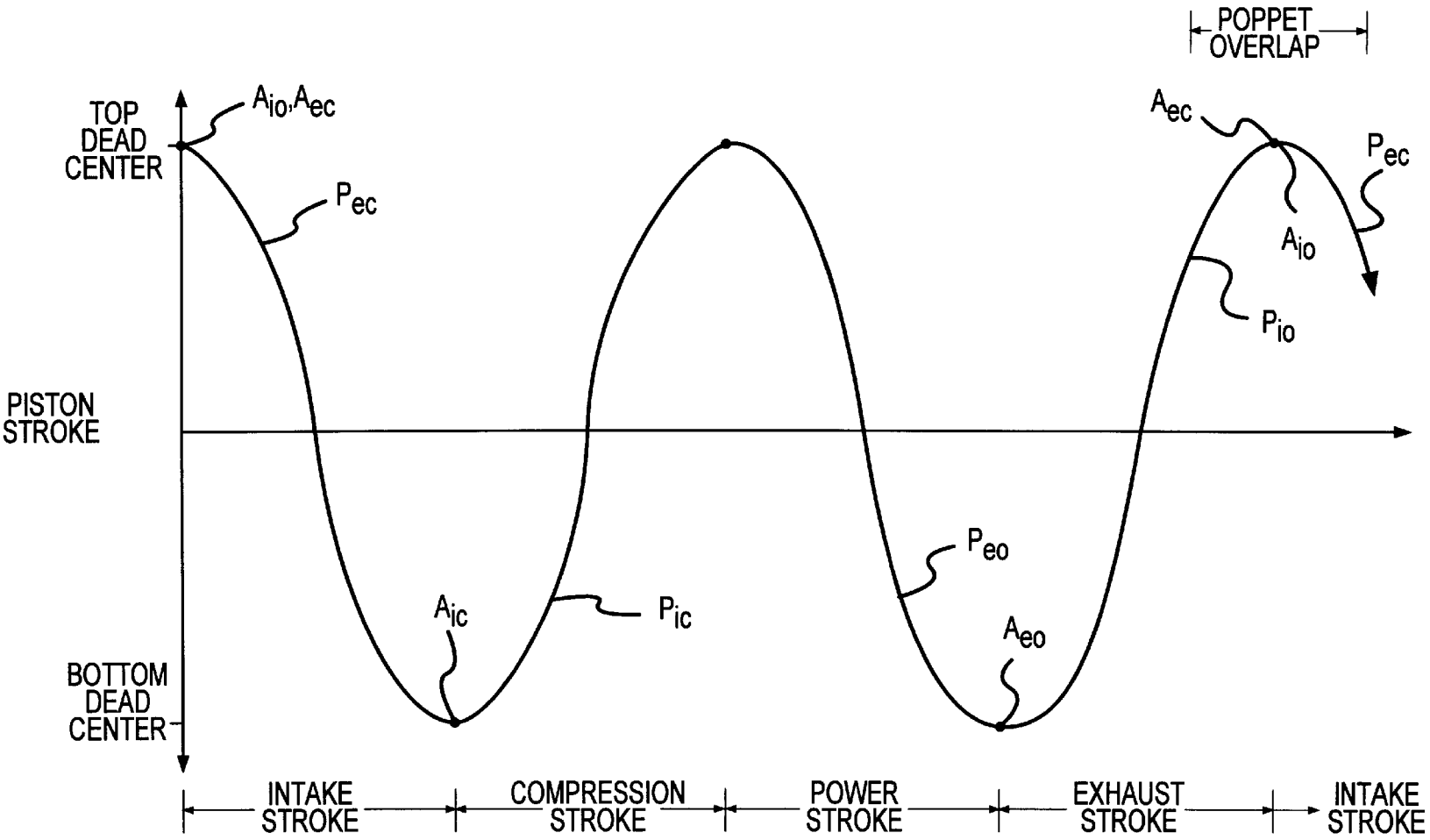
FIG. 7 is a graph depicting the timing of the engine of FIG. 1 and the timing of a conventional poppet valve operated engine.

The resulting timing is depicted in the graph of FIG. 7 and the sequential illustrations of FIGS. 8A–8I. In FIG. 7, the opening and closing of the intake and exhaust passages of the aspiration system of the present invention are identified as follows:

$A_{io}$=intake opening $A_{ic}$=intake closing $A_{eo}$=exhaust opening $A_{ec}$=exhaust closing FIG. 7 also shows, for comparison purposes, the opening and closing of a conventional poppet valve system identified as follows:

$P_{io}$=intake opening $P_{ic}$=intake closing $P_{eo}$=exhaust opening $P_{ec}$=exhaust closing As can be readily observed, the aspiration system of the present invention provides 180° intake and exhaust with no overlap. That is, the intake passage is open from top dead center to bottom dead center of the intake stroke, and the exhaust passageway is open from bottom dead center to top dead center of the exhaust stroke. By contrast, in the poppet valve system, both the exhaust and intake valves are open during a poppet overlap period, resulting in exhausting of unused charge with attendant power loss and emissions concerns. Additionally, the poppet exhaust valve opens during the power stroke resulting in additional power losses.

Figure 8C:
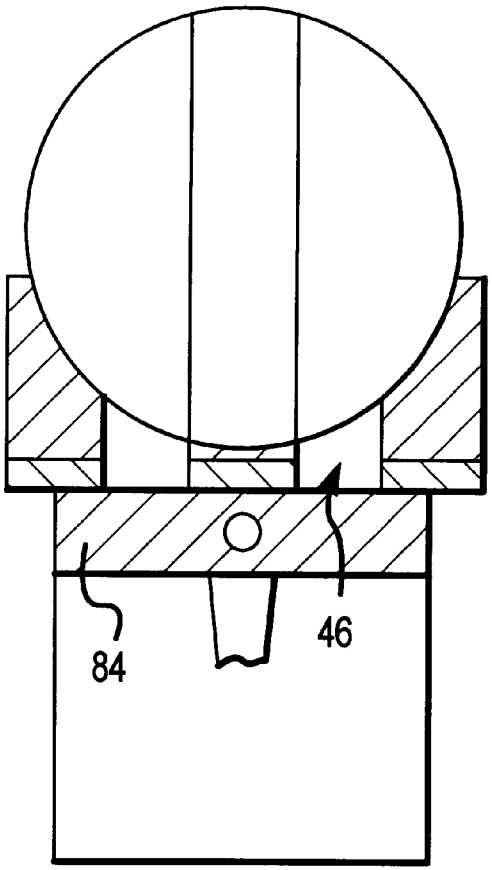
FIGS. 8A–8I show a complete cycle of the aspiration head of FIG. 3.
Figure 8B:
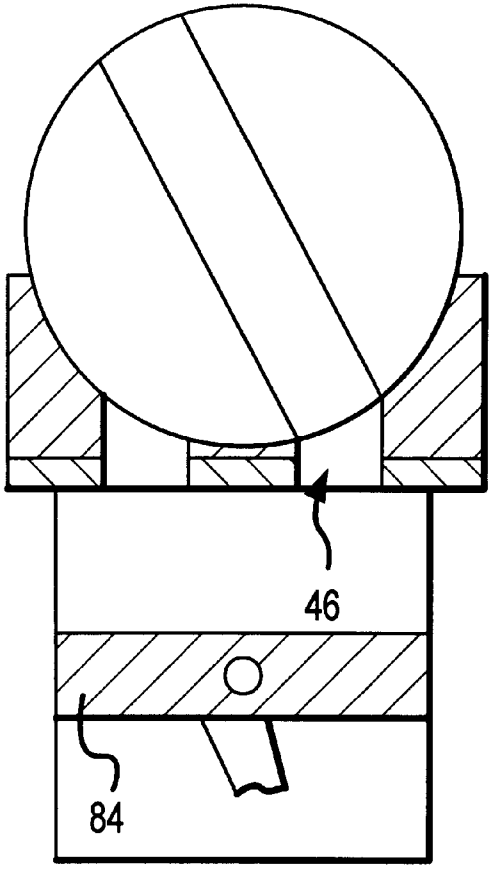
Figure 8A:
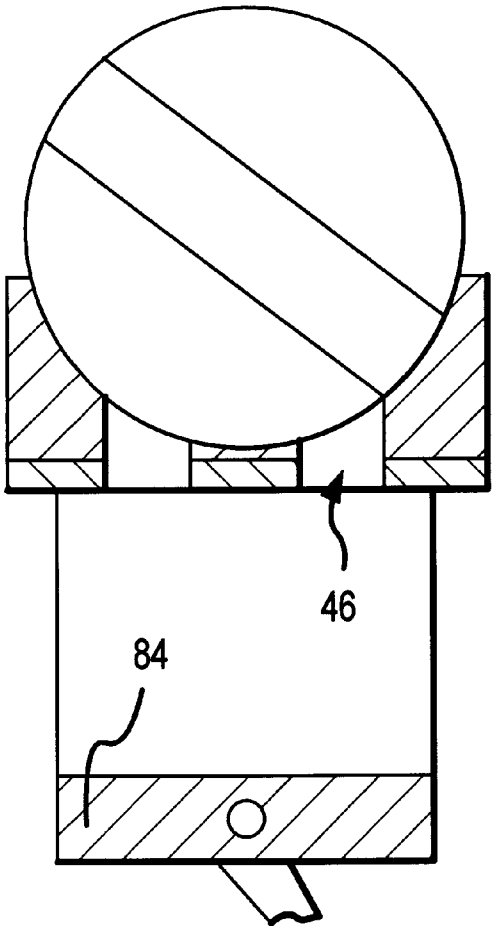
Figure 8F:
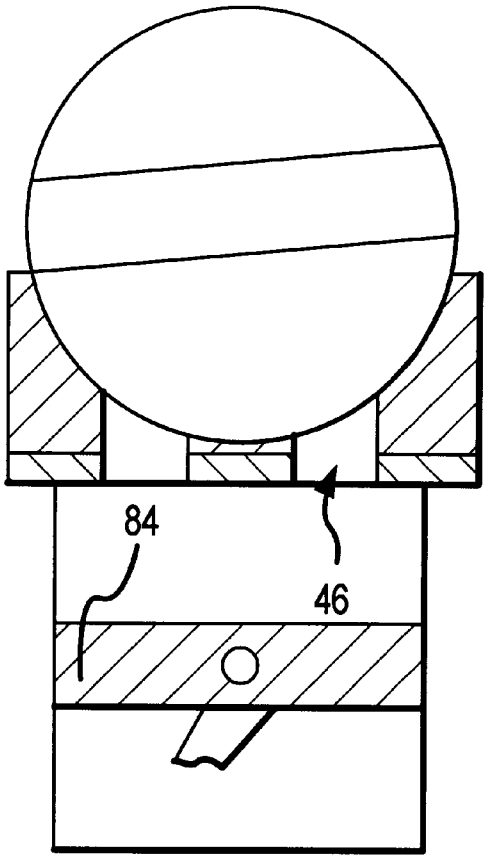
Figure 8E:
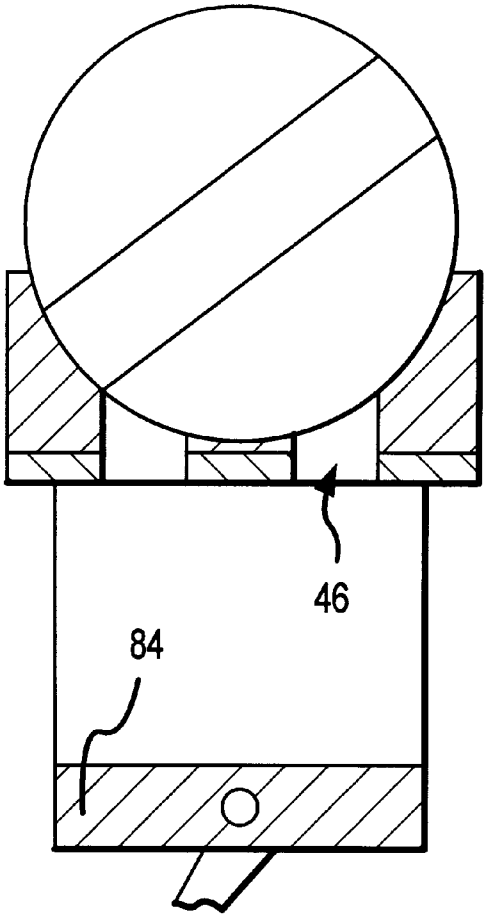
Figure 8D:
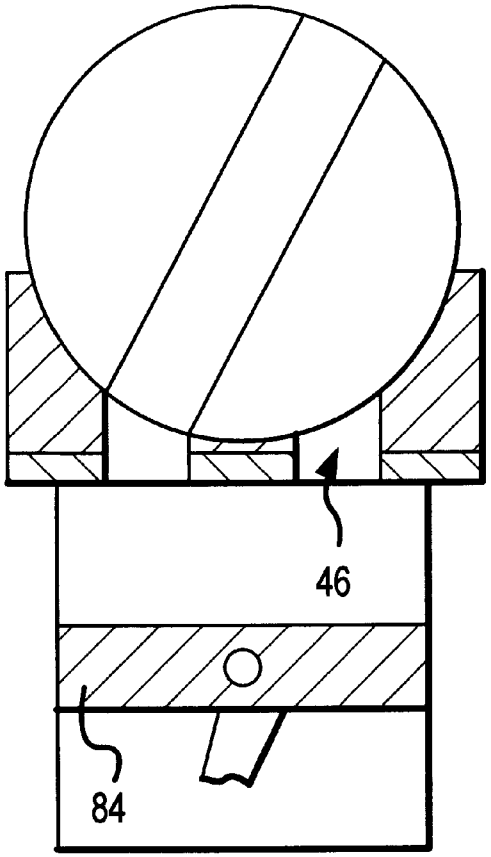

Referring to FIGS. 8A–8I, a complete power cycle (one-half revolution of the rotor) is shown. FIGS. 8A and 8B correspond to the exhaust stroke where the rising piston 84 forces air through the passageway defined by the slots 46 and 48. In FIG. 8C, the piston 84 is at top dead center and, at this moment, the exhaust passageway closes just as the intake passageway opens. The intake passageway defined by slots 46 and 48 remains open during the downward intake stroke as indicated in FIG. 8D and closes at bottom dead center as shown in FIG. 8E. Both passageways are then closed through the compression and power strokes as shown in FIGS. 8E–8I, and then the process repeats. It will be noted that slot 48 thereby defines a part of both the intake and exhaust passageways and alternately receives hot exhaust gas and cool intake gas.

Figure 9:
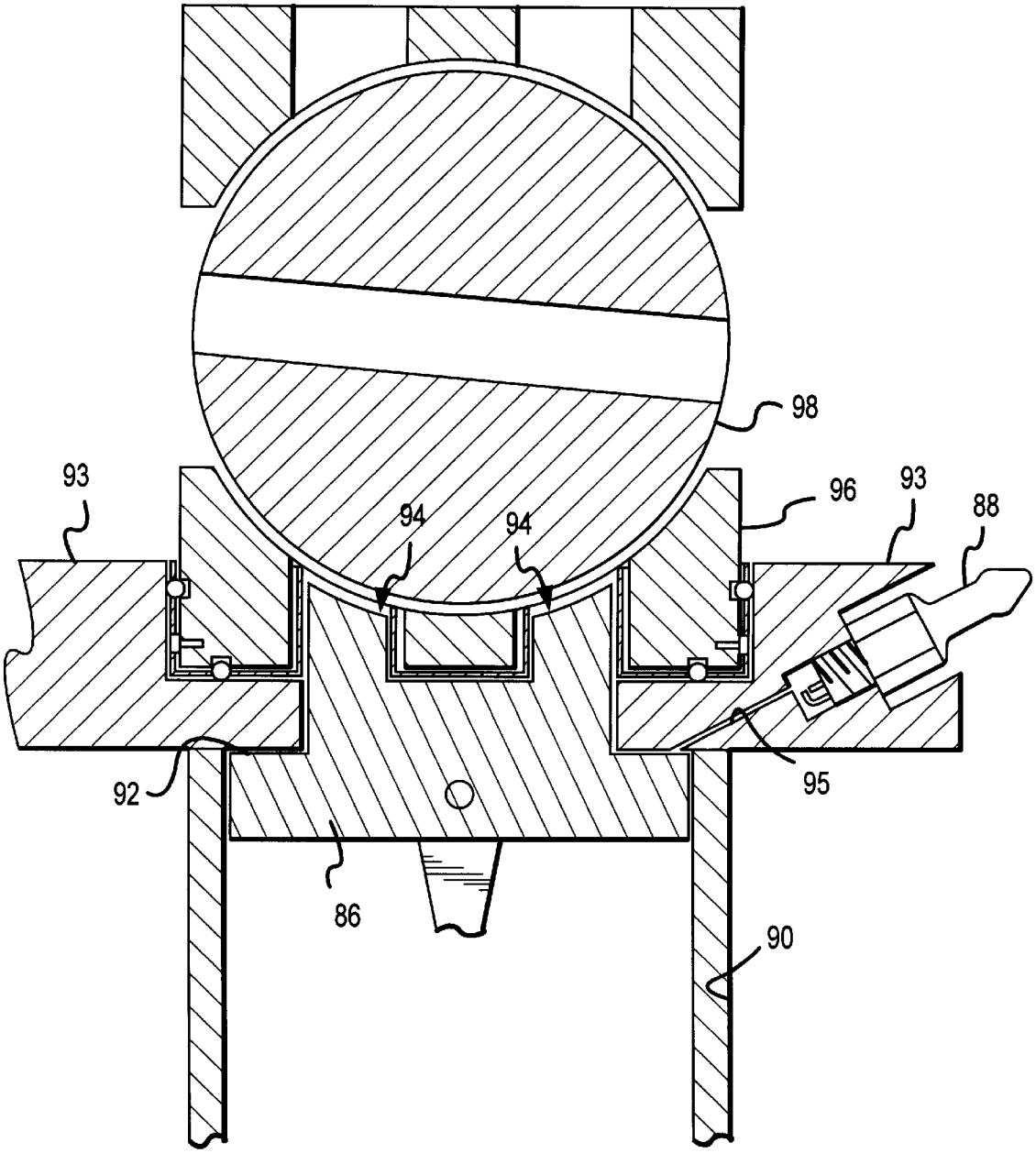
FIG. 9 is a front cross-sectional view showing an alternative embodiment of a piston head according to the present invention.

FIG. 9 shows an alternative embodiment of a piston head 86 in accordance with the present invention, as well as the mounting of a spark plug 88 through base plate 93, the latter being equally applicable to the previous embodiments though not previously shown. As shown, the upper surface 92 of the piston head 86 extends into the passageways 94 of bottom ware plate 96. In this manner, the minimum volume of the combustion chamber defined by the upper surface 92, the rotor 98, the ware plate 96 and the cylinder wall 90 is reduced, thereby increasing the compression ratio. Additionally, the spark plug 88 is exposed to the combustion chamber via a narrow turbulence chamber 95. It is anticipated that the heat generated by the compressed gas in the turbulence chamber would be sufficient to ignite the charge without a spark plug if desired, thereby eliminating the need for an ignition system in a gasoline engine. The fuel may be injected at the turbulence chamber, at the appropriate point in the engine cycle, to control timing.

Figure 10A:
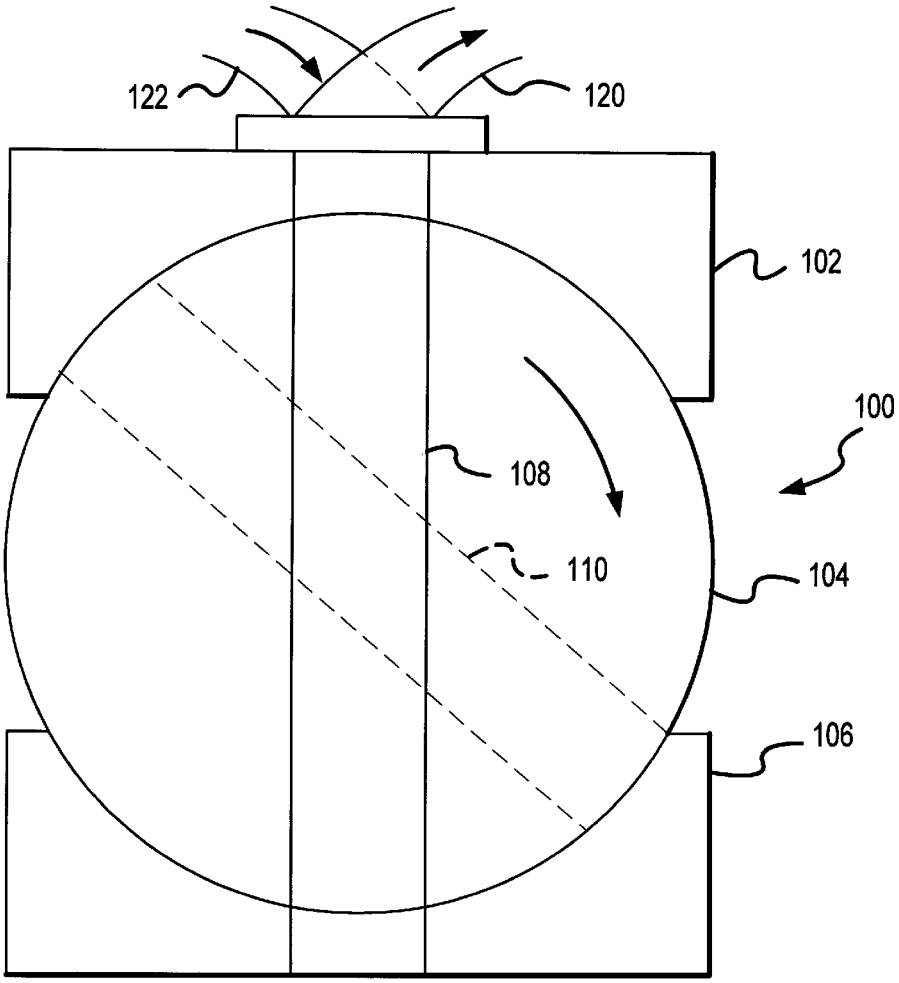
FIGS. 10A–10C shown an alternative embodiment of a rotor block assembly according to the present invention.
Figure 10B:
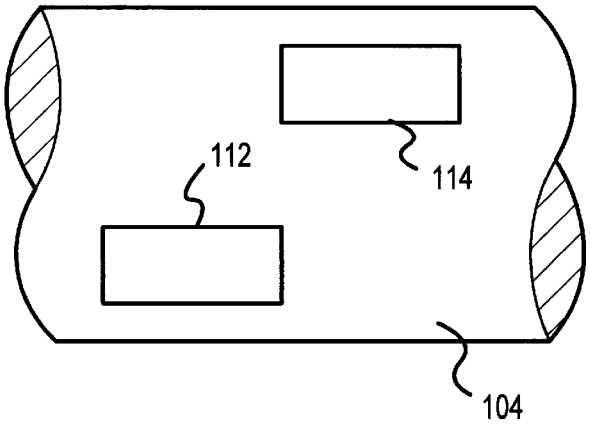
Figure 10C:
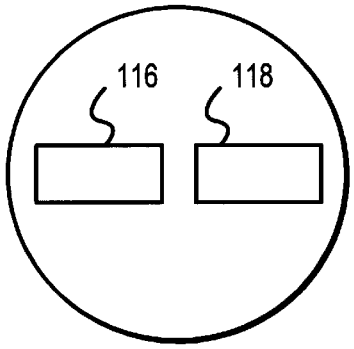

FIGS. 10A–10C show front cross-sectional, side and top views, respectively, of an alternative rotor block assembly 100 according to the present invention. As shown in FIG. 10A, the assembly 100 includes a top ware plate 102, a rotor 104 and a bottom ware plate 106. The rotor 104 includes two slotted passageways 108 and 10 that are angularly offset relative to one another, and are also longitudinally offset, i.e., they do not include a common transverse plane. FIG. 10B shows the ends 112 and 114 of the slotted passageways 108 and 110 of the rotors. FIG. 10C shows slotted passageways 116 and 118 in either one of the ware plates 102 or 106 that are longitudinally aligned with slotted passageways 108 and 110 of the rotor 104.

In the illustrated embodiment, the intake and exhaust paths are entirely separate. In particular, the forwardmost flow line associated with rotor passageway 108, rotor passageway end 112, ware passageway end 116 and exhaust conduit 120 define the exhaust path. The rearwardmost flow line associated with rotor passageway 110, passageway ends 114 and 118 and intake conduit 122 define the intake path. The aspiration timing, which can be selected as described above, is determined by the angular displacement as between rotor passageways 108 and 110 as well as the slot widths.

EXAMPLE

The following tests were performed to compare performance of an engine aspirated in accordance with the present invention to an engine under conventional poppet valve control. The engine employed in both cases was a 2300 cc Ford inline four-cylinder engine, with its normal fuel injection system in both cases. In the first case, the engine was tested with its conventional poppet valve head. In the second case, a rotor-based aspiration system corresponding to the embodiment of FIGS. 1–8 was employed on the engine. All other components and systems were substantially identical as between the two cases.

The following emissions results were obtained using identical standard emissions equipment:

| Parameter | Engine with Poppet Head | Engine with Aspiration System of Present Invention |
|---|---|---|
| RPM | 895 | 1048 |
| Hydrocarbons | 139 PPM | 15 PPM |
| Carbon monoxide | 0.94% | 0.00% |
| Carbon dioxide | 14.4% | 10.4% |
| Oxygen | 0.4% | 6.3% |
| Timing | 0.0 BTDC | 0.0 BTDC |

Figure 8I:
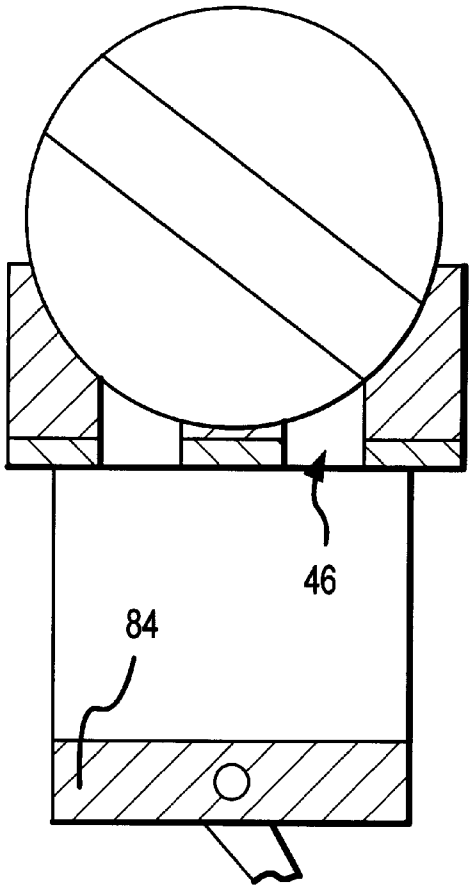
Figure 8H:
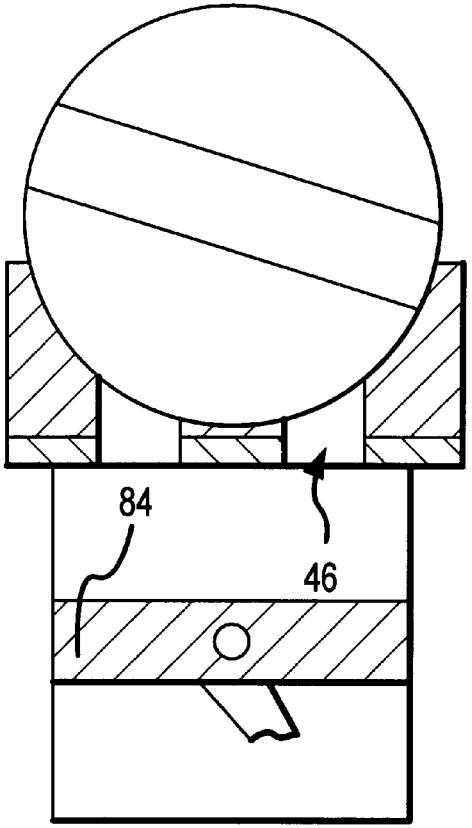
Figure 8G:
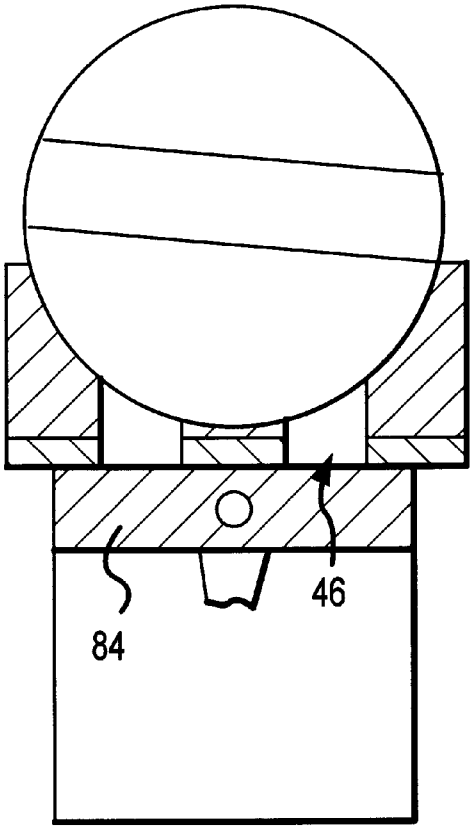

A flow test was also performed on the same engine aspirated using the rotor-based aspiration system of the present invent ion. The equipment employed for the test was the test bench marketed under the trademark SUPERFLO 600, based on timing as illustrated in FIGS. 7–8I. The results indicated a remarkable charge intake flow rate of 302 $ft^3$/min. for the 2300 cc engine. This translates into a flow rate of about 62 times the engine displacement volume per second based on a conversion factor of 1 $ft^3$/min.=471.947 $cm^3$/sec. Higher flow rates per unit of engine displacement volume have been indicated by measurements for larger engines using the aspiration system of the present invention. The engine was also shown to support a compression ratio of 23:1 without premature combustion.

While various embodiments of the present invention have been described in detail, it is apparent that further modifications and adaptations of the invention will occur to those skilled in the art. However, it is to be expressly understood that such modifications and adaptations are within the spirit and scope of the present invention.

We claim:

1. An aspiration system for use in connection with an internal combustion engine including at least one combustion chamber wherein a piston reciprocates along a piston axis, said aspiration system comprising:

a rotor rotatable relative to a rotation axis;

intake means For use in delivering oxygen-containing gas to said combustion chamber, said intake means defining a first intake passageway extending from a first intake passageway end adjacent to said rotor to a second intake passageway end adjacent to said combustion chamber, said first intake passageway being a substantially linear passageway having an intake axis, extending from said first intake passageway end to said second intake passageway end, that is substantially aligned with said piston axis; and exhaust means for use in extracting a combustion product from said combustion chamber, said exhaust means defining a first exhaust passageway extending from a first exhaust passageway end adjacent to said rotor to a second exhaust passageway end adjacent to said combustion chamber, said first exhaust passageway being a substantially linear passageway having an exhaust axis, extending from said first exhaust passageway end to said second exhaust passageway end, that is substantially aligned with said piston axis;

wherein said rotor includes rotor passageway means, extending transversely through said rotor, for alternately allowing communication between said first intake passageway and said rotor passageway means and between said first exhaust passageway and said rotor passageway means.

2. An aspiration system as set forth in claim 1, wherein said rotor comprises a cylindrical body having a central axis that substantially coincides with said rotation axis.

3. An aspiration system as set forth in claim 1, wherein said internal combustion engine comprises a plurality of combustion chambers, and said rotor includes means for use in aspirating each of said plurality of combustion chambers.

4. An aspiration system as set forth in claim 1, wherein said rotor passageway means comprises a substantially straight bore extending diametrically through said rotor.

5. An aspiration system as set forth in claim 1, wherein said first intake passageway and said first exhaust passageway are defined by passages through a head, said head being disposed between said rotor and said combustion chamber.

6. An aspiration system as set forth in claim 5, wherein said head comprises a curved surface for interfacing with an outer surface of said rotor, said curved bearing surface having a curvature that is substantially the same as the curvature of said outer surface of said rotor.

7. An aspiration system as set forth in claim 6, wherein said curved surface of said head is formed from a material that is softer than said outer surface of said rotor.

8. An aspiration system as set forth in claim 1, wherein at least one of said first intake passageway end and said first exhaust passageway end has a dimension that substantially matches a dimension of said rotor passageway means.

9. An aspiration system as set forth in claim 1, further comprising means for rotating said rotor in cooperation with operation of the said internal combustion engine, wherein communication is substantially only allowed between said rotor passageway means and said first intake passageway from top dead center to bottom dead center of an intake stroke of said engine, and communication is substantially only allowed between said rotor passageway means and said first exhaust passageway from bottom dead center to top dead center of an exhaust stroke of said engine.

10. An aspiration system for use in connection with an internal combustion engine including a plurality of combustion chambers wherein pistons reciprocate along piston axes, said aspiration system comprising:

intake means for use in delivering oxygen-containing gas to each of said plurality of combustion chambers;

exhaust means for use in extracting a combustion product from each of said plurality of combustion chambers; and a rotor for con trolling flow through said intake means and said exhaust means, whereby said rotor allows for aspirating of each of said plurality of combustion chamber;

said intake means comprising a plurality of intake passageways, each said exhaust passageway associated with a corresponding one of said plurality of combustion chambers and being a substantially linear passageway having an intake axis, extending from said rotor to said corresponding one of said combustion chambers, that is substantially aligned with said piston axes;

said exhaust means comprising a plurality of exhaust passageways, each said exhaust passageway associated with a corresponding one of said plurality of combustion chambers and being a substantially linear passageway having an exhaust axis, extending from said corresponding one of said combustion chambers to said rotor, that is substantially aligned with said piston axes.

11. An aspiration system as set forth in claim 10, wherein said plurality of intake passageways are spaced along a length of said rotor.

12. An aspiration system as set forth in claim 10, wherein said plurality of exhaust passageways are spaced along the length of said rotor.

13. An aspiration system as set forth in claim 10, wherein said cylindrical rotor has a plurality of passageways formed therein, said passageways being spaced apart relative to a length of said rotor.

* * * * *